United States Patent [19]

Armond

[11] Patent Number: 4,887,184

[45] Date of Patent: Dec. 12, 1989

[54] DEMAGNETIZER

[75] Inventor: Joseph A. Armond, River Forest, Ill.

[73] Assignee: Electro-Matic Products Co., Chicago, Ill.

[21] Appl. No.: 571,387

[22] Filed: Jan. 17, 1984

[51] Int. Cl.[4] ..... H01H 17/00

[52] U.S. Cl. ..... 361/149; 361/267

[58] Field of Search ..... 361/145, 149, 267

[56] References Cited

U.S. PATENT DOCUMENTS

| | | | |
|---|---|---|---|
| 2,946,932 | 7/1960 | Littwin | 361/145 X |
| 3,579,053 | 5/1971 | Littwin | 361/145 |
| 3,626,255 | 12/1971 | Littwin | 361/149 |
| 4,354,149 | 10/1982 | Armond et al. | 361/145 X |
| 4,426,672 | 1/1984 | Armond | 361/145 |

FOREIGN PATENT DOCUMENTS

| | | | |
|---|---|---|---|
| 134146 | 10/1981 | Japan | 361/267 |

*Primary Examiner*—Derek S. Jennings
*Attorney, Agent, or Firm*—Paul H. Gallagher

[57] ABSTRACT

Auto transformer supplying current to the object to be demagnetized (chuck), this current controlled by an ON set of transformers, and a DEMAG set of transformers. Each set includes a pair of secondaries providing pulsating current for respective half cycles of AC, of opposite polarity. The opposite polarity of pulsating current is produced in intervals of decreasing time and voltage, until the magnetism in the object is at or near zero. The control transformer sets are controlled by a unit establishing selected values of voltage, that voltage controlling a cross-over unit which includes transistors, which in turn control the intervals of the control transformers. A CMOS oscillator circuit, with an oscillator chip, including NAND gates, effects alternate energization of the control transformers.

5 Claims, 3 Drawing Sheets

Fig. 1
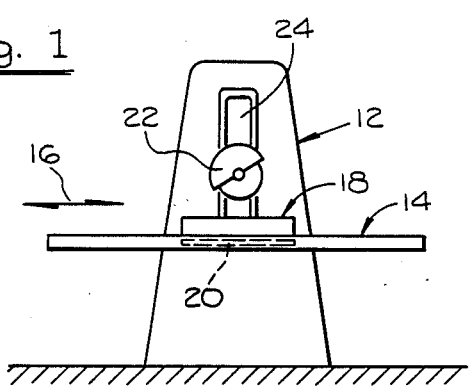
Fig. 2
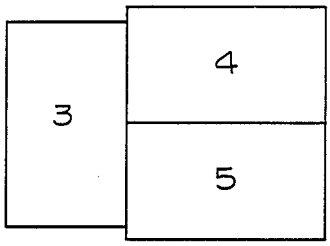
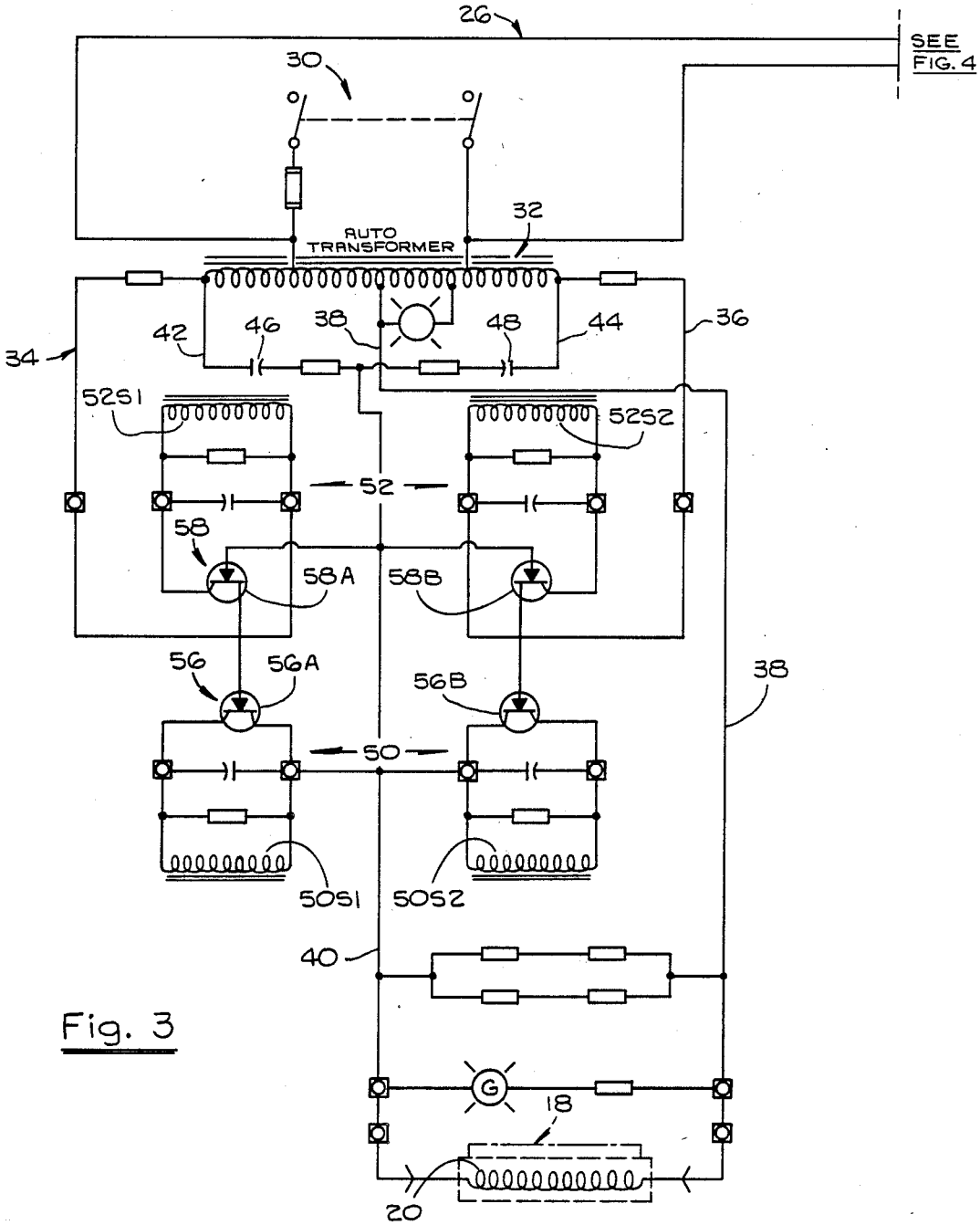
Fig. 3

DEMAGNETIZER

FIELD OF THE INVENTION:

The invention resides in the field of demagnetizing in industry. A principal example of the occasion of such demagnetizing, is in grinding. In the use of a grinder, where a workpiece is held on the chuck by a magnet, the workpiece of course becomes magnetized, and it is then necessary to remove the magnetism from the workpiece, or demagnetize it, for future uses or processes in connection with it.

Broadly, such demagnetizing is done by applying DC to the workpiece in a series of reversed polarities, and reducing the voltage at each reversal, until the magnetism reaches zero, or nearly so.

The broad concept of such demagnetizing is embodied in previous inventions, such as that covered by Littwin patent No. Re: 25,607, dated June 30, 1964, and others.

OBJECTS OF THE INVENTION:

A broad object of the invention is to provide a demagnetizer for use in industry, having the following features and advantages:

1. It is extremely simple in concept and design, and unusually effective because of its simplicity, and correspondingly inexpensive both in materials used and steps of fabrication.

2. It is very accurate in functioning, in relation to timing of the steps taken in the operation thereof, and the level of voltage at which the steps are taken.

3. It is extremely flexible in operation, being effective for demagnetizing articles of any of a wide range of sizes and masses, and in any of a wide range of time limits and rates of operation independently of the sizes and masses of the articles.

4. It is effective, in relation to a magnetic force that is used for holding an article in an installation in which the demagnetizer is used, for demagnetizing the article in a series of steps utilizing maximum magnetic force no greater than that utilized in holding the article in place.

DESCRIPTION OF A PREFERRED EMBODIMENT:

In the drawings,

FIG. 1 is a simplified view of a grinder in which the demagnetizer of the present invention is utilized;

FIG. 2 is a diagram showing the arrangement of FIGS. 3, 4 & 5 fitted together to form a complete circuit diagram;

FIG. 3 is a diagram of a portion of the electrical circuit;

Figure 4:
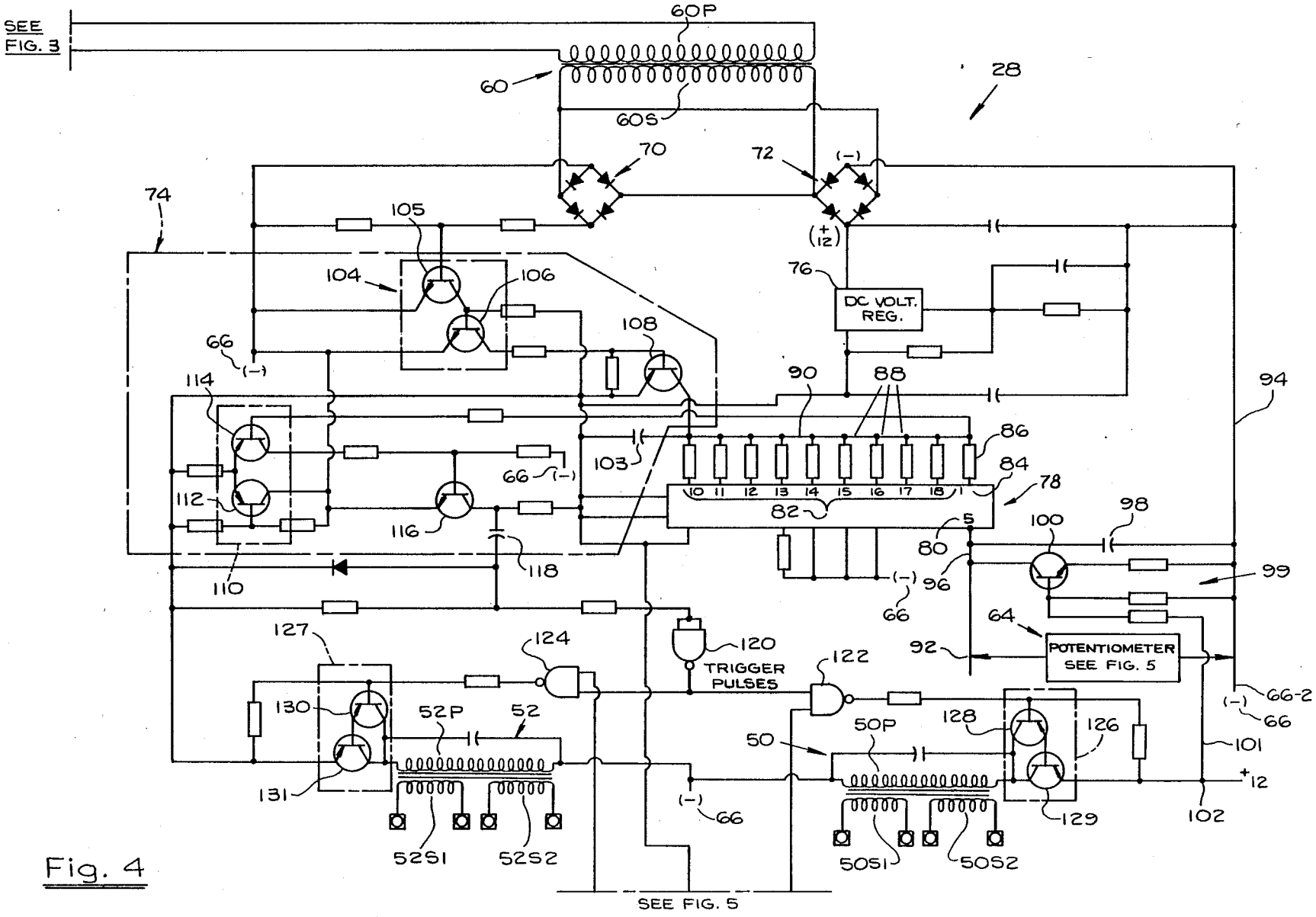
FIG. 4 is a diagram of another portion of the electrical circuit.

The operation of demagnetizing necessarily involves magnetizing itself. A very common application of a demagnetizer is in connection with a grinder. In the use of a grinder, the workpiece is put on the table of the grinder and reciprocated and the grinding wheel is brought down into grinding engagement with the workpiece. The workpiece is held in position on the table, for the grinding operation, by means of a magnetic chuck, and the chuck and workpiece both are of course magnetized. In order to release the workpiece, it is necessary to demagnetize it. In the demagnetizing operation, the workpiece is repeatedly magnetized, that is, it is magnetized in a series of steps in successively reverse directions, or opposite polarities, and the voltage is reduced at each step until the last step and reversal when the magnetism is at or near zero. Thus the demagnetizing operation includes these magnetizing steps. Even in the grinding operation per se, the chuck, and of course the workpiece, are magnetized under the control of the demagnetizer apparatus of the present invention.

In the industry, the term MAG and MAGGING are understood to mean magnetize and magnetizing respectively, and similarly the terms DEMAG and DEMAGGING mean demagnetize and demagnetizing respectively.

Referring in detail to the drawings, FIG. 1 shows a grinder 12 of known kind, having a table 14 that reciprocates horizontally as indicated by the double headed arrow 16, and the workpiece to be treated, indicated at 18, is placed on the table and held thereon by a magnetic chuck 20 embedded in the table. A grinding wheel 22 works in a vertical slot 24 and is brought down into working engagement with the workpiece, performing the grinding operation as the workpiece is reciprocated under it, by the table.

Figure 5:
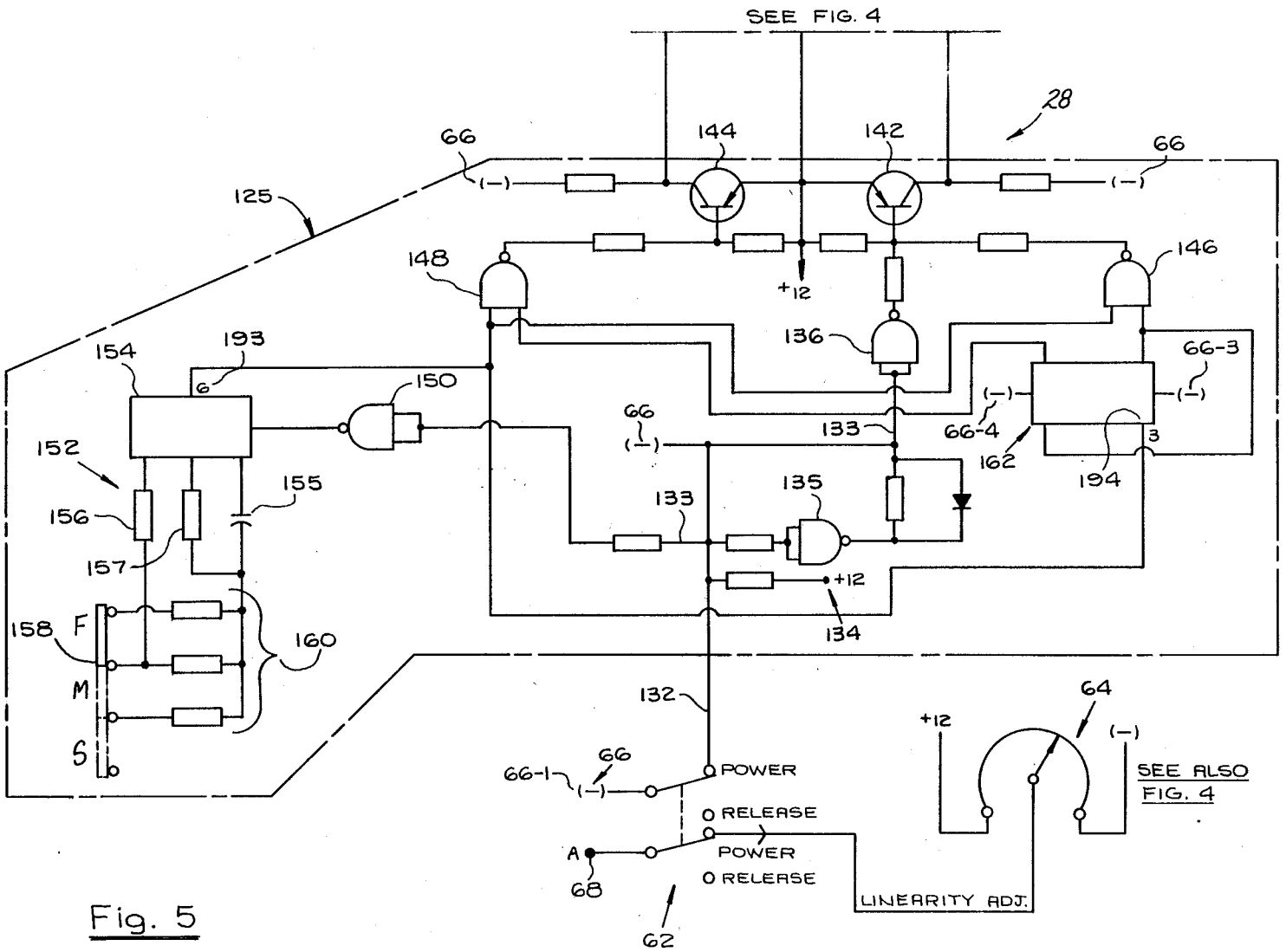
FIG. 5 is a diagram of the final portion of the circuit.

Referring to the electrical circuit, FIG. 2 shows the proximate positioning of FIGS. 3, 4 & 5, and it will be noted that the chuck 20 and workpiece 18 are found in FIG. 3 at the bottom.

The circuit of FIGS. 3–5 includes a power circuit 26 in FIG. 3 and a control circuit 28 in FIGS. 4 and 5. The circuit includes an AC source 30 leading to an auto transformer 32 and conductors 34, 36, 38, 40 leading from the auto transformer to the chuck 20. Other conductors 42, 44 lead from the ends of the transformer to the conductor 40, and are provided with capacitors 46, 48 therein.

The power circuit 26 includes the secondaries of certain magnetizing transformers, the complete transformer being incorporated in FIG. 4. Each transformer includes a primary and two secondaries, each being referred to as a set, and are referred to as an ON set 50 and a DEMAG set 52. In the identification of the transformers, the primaries are identified with the same main reference numeral with the subscript P and the secondaries also with the same main reference numeral but with the subscript S and additional subscript numerals 1 and 2. These transformers function to control the current passing from the auto transformer 32 to the chuck 20 and are operatively associated with SCR's 56, 58, the SCR's 56 being individually identified 56A, 56B associated with the secondaries 50S respectively. Similarly SCR's 58, individually identified 58B, 58B are operatively associated with the secondaries 52S respectively. Upon the energization of the secondaries 50S, 52S, as explained hereinbelow, these secondaries turn on the valves 56, 58 and control the current from the auto transformer 32 to the chuck 20. The transformer set 50 is utilized for holding the workpiece on the chuck in the grinding operation, and both sets are utilized for performing the demagging operation.

Referring to the control circuit of FIGS. 4 and 5, a main or control transformer 60 leads from the AC source 30. Also included in the control circuit 28, in FIG. 5 thereof, are a power/release switch 62 and a potentiometer 64, the latter also appearing in FIG. 4, lower right. The power/release switch 62 is manually actuated between a POWER position (FIG. 5) and a RELEASE position. It is connected at two points, common (−) 66-1 and a post 68.

The circuit includes a number of common (−) connections all being identified 66, and certain ones with additional post-script numerals, such as 66-1, 66-2, etc.

Leading from the secondary 60S are two full wave bridge rectifiers 70, 72, the former leading to a triggering circuit 74, the latter leading to a DC regulator 76. A dot/bar driver 78 (FIG. 4), of known kind, is incorporated in the control circuit and includes an input pin 80, at #5, and a series of pins 82, #10–18, and a pin 84, #1, at a reference position. Pin #1 is connected to resistor 86, and the other pins are connected to resistors 88, these resistors being connected to a common conductor 90.

As referred to above, the potentiometer 64 appears at FIG. 4, lower right, connected between ground 66-2 and a post 92 which is of +V. The common (−) 66-2 is connected to a conductor 94 leading from the rectifier 72 and the post 92 is in a conductor 96 leading to the pin 80, #5, in the driver 78. A capacitor 98 is connected across the conductors 94, 96, parallel with the potentiometer 64 and parallel with a unit 99 which includes a transister 100 and a conductor 101 leading to a +V post 102. The capacitor 98 and the unit 99 provide linear decay in the demagnetizing steps.

As indicated above, the driver 78 is of known kind, and in its operation, in essence, in response to voltage being applied to the input pin #5, certain ones of the resistors 86, 88 are put in circuit. This is in accordance with the internal functioning of the driver according to its nature. When no voltage is applied to the pin #5, none of the resistors are in circuit, and as selective increased levels of voltage are applied, the greater the number of those resistors that are put in circuit, and hence the greater output voltage. The circuit thus established through the driver 78 functions to control the demagnetizing cycles, as referred again hereinbelow.

Voltage of a suitable value, in this case 12V, is transmitted from the transformer 60 through the rectifier 72 to the terminals 66-2, 92 (FIG. 4, lower right), and according to the setting of the potentiometer 64 (see FIG. 5), voltage of a corresponding level is transmitted to the unit 78. According to the number of resistors 88 turned on, which is according to the predetermined applied voltage, a corresponding output voltage is applied to a capacitor 103 in the output conductor 90. A zero crossing detector 104, including transistors 105, 106, turns on a transistor 108 at each zero crossing of the unit 104. This discharges the capacitor 103 and initiates a phase timing sequence or delay. Associated with the capacitor 103 is a transistor unit 110 including transistors 112, 114. Transistor 112 is used as a voltage reference, and when the voltage on the capacitor 103 rises above that reference voltage, the transistor 114 will turn on. The transistors 112, 114 are arranged so that any variation in voltage in the transistor 114, caused by temperature change, will be compensated for by a similar variation in the transistor 112. Another transistor 116 buffers the output from the unit 110, which is then differentiated by a capacitor 118, and adjusting the value of the capacitor 118 will either increase or decrease the trigger pulse width which appears at the output of a NAND gate 120. The NAND gate 120 is connected between associated NAND gates 122, 124 related to respective transformers 50, 52, identified above. The NAND gates 122, 124 are alternately enabled or energized according to the functioning of a CMOS oscillator circuit 125 (FIG. 5) referred to below, the transformer 50 being controlled by the NAND gate 122 and acting as a holding transformer in the normal operation of the grinding machine, while both transformers alternately function in the demagging operation. Additional transistor units 126, 127 are associated with respective transformers 50, 52, the former including transistors 128, 129 and the latter including transistors 130, 131.

Reference is now made to the oscillator circuit 125 (FIG. 5) which functions to control the demagging operation. The following description has to do with the actual demagging or reversing steps, which is independent of the values of the voltage utilized in the triggering circuit 74 (FIG. 4). As noted above, the power/-release switch 62 is utilized for turning on the apparatus and for putting it in release phase. To turn on the apparatus, the switch is moved to POWER position and when in this position, a negative electric signal derives from common (−) point 66-1 and is transmitted by conductors 132, 133 leading to a unit 134. This unit includes NAND gates 135 and 136 and leads to the base of the transistor 142 and enables or energizes the NAND gate 122 which turns on transistors 128, 129, and the transformer 50 is energized, and it remains energized as long as the switch 62 remains in POWER position. The transformer 50 functions to retain the secondaries 50S.1, 50S.2 (FIG. 3) energized and the power applied to the chuck as will be referred to again hereinbelow.

The CMOS oscillator circuit 125 includes another transistor 144, and three NAND gates 146, 148, 150, the first associated with the transistor 142 and the second with the transistor 144, while the third, 150, is associated with an RC network 152. This RC network includes a CMOS oscillator chip 154, and a capacitor, 155, and resistors 156, 157. This network also includes a demagging slide switch 158 which is slidable to positions indicated, namely fast, medium, slow, and is associated with a plurality of resistors 160 arranged for respective connection in the network according to the position of the slide switch to produce the corresponding speeds in demagging. The oscillator circuit additionally includes a flip-flop unit 162.

For performing the demagging operation, the switch 62 is moved to RELEASE position. The capacitor 155 and the resistors 156, 157 determine the overall operating frequency, while the switch 158 provides the fast, medium or slow cycle time applied to pin 193, #6, of the chip 154. The output from this pin #6 is applied to one input of NAND gates 148, 146 and the clock input 194, pin #3, of the flip-flop unit 162. The outputs of the unit 162 enable, or disable, the NAND gates 148, 146, and thus turn ON or OFF either of the transistors 142, 144, depending on the cycle. The transistor 142 enables the NAND gate 12, while the transistor 144 enables the NAND gate 124, and in the latter case the transformer 52 is energized, and this energizes the secondaries 52S, consituting the DEMAG set (FIG. 3). As will be understood, the transistors 142, 144 are enabled or energized alternately and not simultaneously, with consequent alternate energization of the transformers 50, 52.

In further explanation of the action of the transformers 50, 52—while the transformer 50, for example, is energized, as controlled by the NAND gate 122, the ON set of secondaries 50S.1, 50S.2 (FIG. 3) are energized, turning on the SCR's 56, and completing circuit from the auto transformer 32 to the chuck. In this phase or mode, whenever the transformer 50 is energized, the chuck is energized, and this is true both in the holding and the demagging.

In the alternate intervals in which the transformer 52 is energized, in the demagging phase or mode, the secondaries 52 in the DEMAG set are energized, and these turn on the SCR's 58, completing circuit from the auto transformer 32 to the chuck.

In the case of both transformers 50, 52, it will be noted that in each case, the secondaries are opposed so as to provide full wave rectification of the current, and constant holding power in the chuck. Corresponding with this attitude, each set, that is, the ON set, and the DEMAG set, in the demagging phase or mode, functions at the corresponding intervals as determined by the triggering and oscillator circuits as referred to above and as referred to again hereinbelow.

In grinding operations, workpieces of various sizes are encountered or handled, and as noted above, they are held in place by magnetism, and it is important that the workpieces be held by a force approximating that only necessary to hold them, and not more. In many cases, excessive holding power distorts the workpieces, and it is desired of course to avoid this situation. Accordingly, only that holding power that is estimated to be proper is applied. It is so applied in the present case by setting the potentiometer 64 at the proper position according to the range of voltage supplied, which in this case is up to 12 volts, and the potentiometer is active throughout the full range from zero to that maximum. In a particular case, assuming that it is desired to apply three-fourths of the full voltage to the holding, the potentiometer is then set at that position, as indicated in the drawing, and the switch 62 turned on. A corresponding voltage is applied (FIG. 4) between the points 66-2 and 92, the latter leading to pin 80 (#5), and this voltage is applied to the unit 78 and it also charges the capacitor 98. As noted above, the value of the voltage so applied determines which of the resistors 88 are put in circuit, and the consequent total value thereof, and the resulting value of the voltage applied to the capacitor 103. The voltage set at the potentiometer 64 produced a linearly proportionate voltage effective from the auto transformer 32—for example, if the potentiometer is set at three-fourths, or 9V. of the 12V., the voltage produced by the auto transformer will be three-fourths of 115V. (e.g.) or 86.28V. In the power phase or mode, after the switch 62 is so turned on, the system remains stable and the grinding operation is then performed. After it is completed and it is desired to demagnetize, the switch 62 is moved to RELEASE position, and the potentiometer 64 (FIG. 5) is thereby disconnected. This leaves the capacitor 98 in circuit and it begins to decay, and the rate of decay is that determined by the unit 99, which, as stated above, produces a linear rate thereof.

The zero crossing detector 104, at each zero crossing, turns on the transistor 108, which discharges the capacitor 103, and initiates the phase timing sequence or delay. This phase delay is arrived at in response to the capacitor 103 being charged by the RC time constant, which is determined by the value on the capacitor and the number of resistors 88 turned on in the unit 78. The voltage across the capacitor 103 is monitored by the transistor 114 and when the voltage on the capacitor 103 rises above the reference voltage set by the transistor 112, the transistor 114 will turn on. In the release cycle, the decay of the voltage in the capacitor 103 determines the decay cycle time length, while the decay of the capacitor 98 determines the overall time of the demagging cycle.

We claim:

1. Apparatus demagnetizing a chuck having an electromagnet in operative association therewith, and circuit means connecting a chuck in circuit with an electric source of predetermined voltage value, comprising, said circuit means including a power circuit and a control circuit, the power circuit directly including a chuck, the circuit means including two sets of transformers including a ON set and a DEMAG set, each set including a primary and a pair of secondaries, the control circuit including the primaries and the power circuit including the secondaries and first gate means controlled by the secondaries, the first gate means being interposed between the electric source and the chuck and controlling the chuck, the power circuit conducts current from an AC source to the chuck, the secondaries of each set and corresponding first gates produce unidirectional current in respectively reverse directions, the control circuit including a triggering circuit, energizing said sets of transformers, second gate means for controlling the triggering circuit, the triggering circuit effecting current in successively opposing directions through a chuck and at successively reduced voltage for degmagnetizing the chuck, manually settable means controlling the triggering circuit and operable through a range between low and high points and operable in response to being set in a predetermined point in said range, for effecting application of voltage from said electric source to the chuck of a value that is a portion of said predetermined value of the voltage of the source in proportion to the setting of said manually settable means in its range, the triggering circuit including a driver unit which includes a plurality of resistances, and control means for controlling the driver unit including a manually settable potentiometer and a capacitor, and the potentiometer and capacitor being operable for determining the number of resistances put in circuit and thereby determining the value of the voltage applied to the transformers.

2. Apparatus according to claim 1 wherein, the resistance means includes a plurality of resistors, and the potentiometer and capacitor are so operable for determining the value of the resistance by determining individual ones of the resistors in the circuit.

3. Apparatus according to claim 2 wherein, the control circuit is operable for predetermining a maximum voltage corresponding to the setting of the potentiometer and imposing such predetermined voltage on both said transformers, whereby in the demagnetizing steps, the voltage applied to the chuck in the first such step is at least as low as said maximum and in the remaining steps lower than said maximum.

4. Apparatus according to claim 3 wherein, the control circuit includes transistor sensing means operable for controlling the pulses to the transformer in response to sensing the level of voltage on said driver unit.

5. Apparatus according to claim 4 wherein, the control circuit includes an oscillator circuit, and the oscillator circuit includes means for predetermining the duration of pulses transmitted to the transformer, and of the intervals between pulses.

* * * * *